US010207897B2

(12) United States Patent
Hess et al.

(10) Patent No.: US 10,207,897 B2
(45) Date of Patent: Feb. 19, 2019

(54) SLIDING GUIDE SHOE FOR AN ELEVATOR

(71) Applicant: Inventio AG, Hergiswil NW (CH)

(72) Inventors: Stephan Hess, Emmenbrücke (CH); Hubert Steiner, Ebikon (CH)

(73) Assignee: INVENTIO AG, Hergiswil (CH)

( * ) Notice: Subject to any disclaimer, the term of this patent is extended or adjusted under 35 U.S.C. 154(b) by 301 days.

(21) Appl. No.: 14/913,732

(22) PCT Filed: Aug. 22, 2014

(86) PCT No.: PCT/EP2014/067888
§ 371 (c)(1),
(2) Date: Feb. 23, 2016

(87) PCT Pub. No.: WO2015/032632
PCT Pub. Date: Mar. 12, 2015

(65) Prior Publication Data

US 2016/0207737 A1 Jul. 21, 2016

(30) Foreign Application Priority Data

Sep. 3, 2013 (EP) ..... 13182723

(51) Int. Cl.
*B66B 7/04* (2006.01)
*B66B 19/00* (2006.01)

(52) U.S. Cl.
CPC ..... *B66B 7/047* (2013.01); *B66B 19/007* (2013.01)

(58) Field of Classification Search
CPC ..... B66B 7/04; B66B 7/047; B66B 7/048
See application file for complete search history.

(56) References Cited

U.S. PATENT DOCUMENTS 1,485,302 A * 2/1924 Sharp ..... B66B 7/047 187/409
1,907,966 A * 5/1933 Henry ..... B66B 7/047 187/409
2,057,118 A * 10/1936 Sanford ..... B66B 7/047 187/409
2,103,480 A * 12/1937 Mason ..... B66B 7/047 187/409
4,598,798 A * 7/1986 Koppensteiner ..... B66B 7/048 187/409
2013/0098714 A1 4/2013 Kocher et al.
(Continued)

FOREIGN PATENT DOCUMENTS

CH 374168 A 12/1963
CN 103034298 A 4/2013
(Continued)

OTHER PUBLICATIONS

JP-2010149946-A English Translation.*

*Primary Examiner* — Minh Truong
(74) *Attorney, Agent, or Firm* — William J. Clemens; Shumaker, Loop & Kendrick, LLP

(57) ABSTRACT

A sliding guide shoe for an elevator includes a two-part insert that can be inserted into a guide shoe housing for guiding an elevator car along a guide rail. The insert has a carrier element with a recess which is designed as a receiving pocket for receiving a sliding element so that the sliding element can be introduced into the carrier element in a longitudinal direction and then latched in the carrier element.

11 Claims, 3 Drawing Sheets

(56) References Cited

U.S. PATENT DOCUMENTS

| | | | | |
|---|---|---|---|---|
| 2013/0126278 | A1* | 5/2013 | Sederholm | B66B 7/04 187/409 |
| 2015/0239710 | A1* | 8/2015 | Det | B66B 7/047 187/409 |

FOREIGN PATENT DOCUMENTS

| | | | | | |
|---|---|---|---|---|---|
| DE | 20315915 | U1 | | 2/2005 | |
| JP | H04-9873 | | * | 1/1992 | |
| JP | 2000016720 | A | | 1/2000 | |
| JP | 2001261259 | A | * | 9/2001 | B66B 7/047 |
| JP | 2010149946 | A | * | 7/2010 | |
| JP | 2014234268 | A | * | 12/2014 | |
| WO | 2013060583 | A1 | | 5/2013 | |

* cited by examiner

Fig. 3
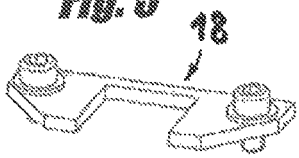
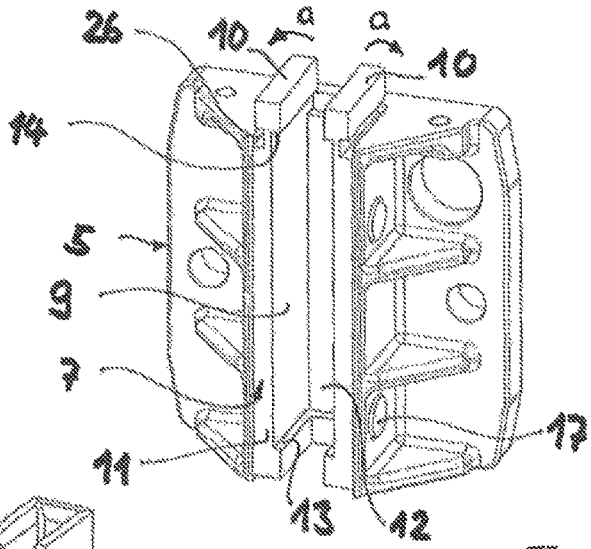
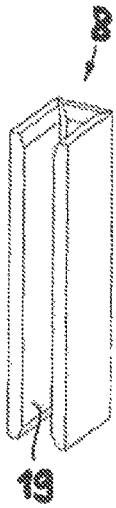
Fig. 4
Fig. 5
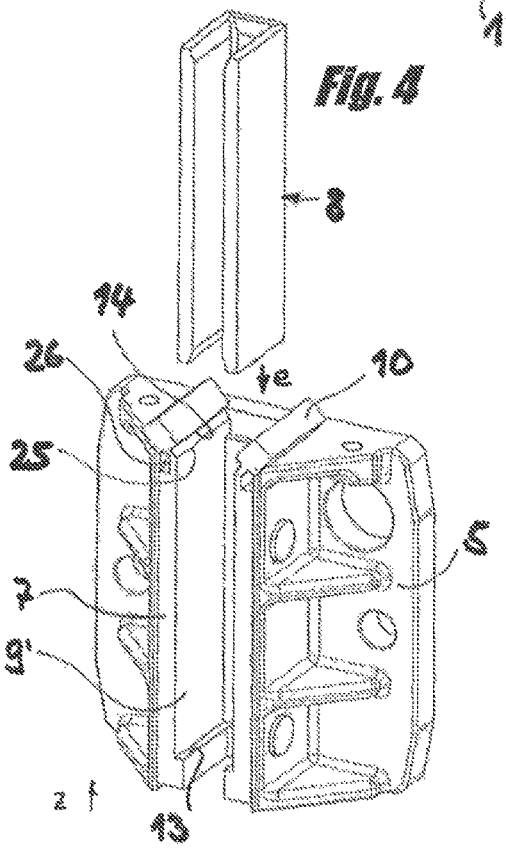
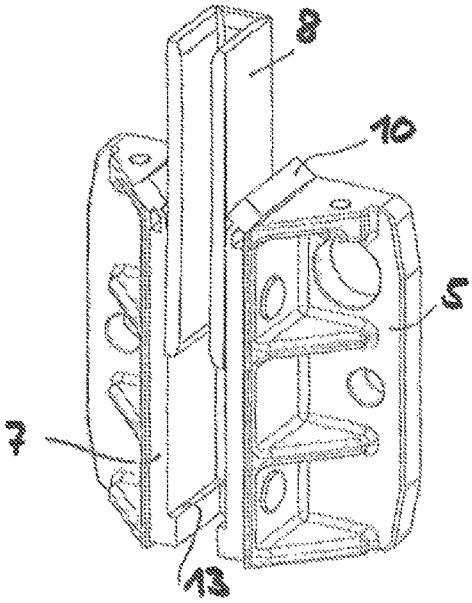

SLIDING GUIDE SHOE FOR AN ELEVATOR

FIELD

The invention relates to a sliding guide shoe for an elevator for conveying persons or goods.

BACKGROUND

Sliding guide shoes are frequently used for the guidance of elevator cars. Elevator installations in buildings have an elevator shaft which is usually vertical and in which a respective guide rail is arranged at each of mutually opposite shaft walls. Sliding guide shoes arranged at the elevator car contain inserts with slide surfaces which slide with small play along a guide rail. Sliding guide shoes in which the inserts are formed as profile members of U-shaped cross-section are known. By contrast to rolling guide shoes, the sliding guide shoe basically manages without movable parts. Since the inserts wear in the course of time, used or old slide inserts have to be exchanged.

A sliding guide shoe which is comparable in terms of category has become known from WO 2013/060583 A1. The sliding guide shoe comprises a two-part insert, which is inserted into a guide shoe housing, with a carrier element and one or more slide elements. The slide element can be pushed from a longitudinal side into a recess, which extends in longitudinal direction, in the carrier element. Since the recess is open in the region of the longitudinal side, the slide element has to be secured with the help of a retaining part. If the retaining element is screw-connected with the guide shoe housing, the slide element is clamped in place between a shoulder formed by the recess and the retaining element.

SUMMARY

It is an object of the present invention to create a sliding guide shoe of the kind stated in the introduction which is simple to handle. In particular, slide elements shall be able to be inserted in simple manner for the initial assembly of the sliding guide shoe or old slide elements shall be able to be rapidly and efficiently replaced for maintenance or inspection work.

According to the invention this object is fulfilled by a sliding guide shoe with the insert inserted or insertable into a guide shoe housing and comprising a slide element facing the guide rail and a carrier element for carrying the slide element. The two-part insert thus has an inner insert part (slide element) and an outer insert part (carrier element). The carrier element with the recess is in that case designed in such a way that the slide element is introducible in longitudinal direction into the recess or removable from the sliding guide shoe so that after the end of the introduction process the slide element is captively fixed in the carrier element at least with respect to the longitudinal direction. The special design of the carrier element ensures that on introduction of the slide element into the receiving pocket the slide element can be secured in terms of position in simple manner in the carrier element solely as a consequence of the introduction process and thus, as it were, automatically and without use of further components.

The slide element can be fixed in the carrier element in particularly simple manner if the arrangement is designed in such a way that the slide element is detentable by pushing in insertion direction along the longitudinal direction into the carrier element.

The carrier element can comprise at least one movable or flexible securing section for securing or fixing the slide element inserted into the guide shoe housing, which securing section is movable outwardly or deformable for freeing an introduction opening. The freeing enables pushing of the slide element in insertion direction into the recess of the carrier element, which recess in the installed state extends along the longitudinal direction. The slide element can be removed again from the carrier element in the same mode and manner. For removal of the slide element, the mutually opposite securing sections are urged outwardly, whereby the detent locking is unlocked and the slide element can be withdrawn in longitudinal direction without resistance.

The securing section can be a flexible securing section which is preferably integrally formed at the carrier element and forms together with the carrier element a component of monolithic form. The carrier element can consist of, for example, a plastics material. For insertion of a slide element, the securing section is moved or urged outwardly by hand or by a tool from a rest setting to an open setting. The slide element can be pushed in simple manner into the now-open introduction opening. After or even during pushing-in of the slide element the securing section can be released. Thanks to the resilient characteristics of the plastics material the securing section returns to the original rest setting without further action.

The securing section could, however, also have a detent lug with a run-up flank which co-operates with the slide element and which is urged away when the slide element is inserted.

In a further form of embodiment the carrier element in the inserted state can project beyond the guide shoe housing by at least a section, whereby the securing section is exposed and can be urged away in simple manner from the outside.

If the carrier element at least in the inserted state is designed as a profile member, which is U-shaped in cross-section, with two limbs associated with the planoparallel guide surfaces of the guide areas of the guide rails and a profile member base connecting the limbs and associated with the front guide surface of the guide rail it can be advantageous if only the limbs project beyond the guide shoe housing. The profile member base can thus be constructed to be shortened relative to the profile member limbs. The profile member base is so dimensioned with respect to the longitudinal direction that when the carrier element is inserted into the guide shoe housing the profile member base is set back or approximately flush with the adjacent housing upper side of the guide shoe housing.

In addition, it can be advantageous if the carrier element is locally weakened in the region of the securing section, whereby the securing section can be more easily moved for freeing the introduction opening. It is possible for, for example, a bending line, about which the securing section can be kinked, to be predetermined by the local weakening.

With particular advantage the local weakening can be a recess extending transversely to the longitudinal direction. This recess can be arranged at the outer side of the limb facing the guide shoe. The recess ensures that, for example, in the case of use of a plastics material which is comparatively hard and thus has poor capability of bending the securing section nevertheless can be moved outwardly without excessive expenditure of force and without the risk of unintended material damage.

In a further form of embodiment a securing part for securing the securing section in a rest setting can be mountable or mounted at the guide shoe housing. The securing section is supported laterally outwardly by the securing part, whereby an outward movement or a deformation of the securing section is prevented.

A lubrication attachment can be fastened or fastenable at the longitudinal end of the guide shoe housing preferably in the region of the introduction opening predetermined by the securing sections and can in a given case additionally or alternatively to the securing part secure the securing section or sections in the rest setting. The lubrication attachment has a support structure with a recess for an oil insert. The oil insert can be captively inserted, preferably by light clamping, in the support structure. The oil insert can consist of, for example, a felt saturated or saturatable with oil. The felt element has inner surfaces which face the slide surfaces of the guide rail and which contact the slide surfaces and thus the guide rails are coated with a slight oil film as soon as the car travels.

The slide element can be formed by a U-shaped profile member, which can be of rigid form. The slide element can accordingly have two mutually opposite slide surfaces and a slide surface extending transversely thereto. In that case it can be a slide element which is formed as an integral and preferably monolithic component which predetermines the three afore-mentioned slide surfaces.

A further aspect of the invention could relate to a car for an elevator with at least one sliding guide shoe in the manner described in the forgoing.

DESCRIPTION OF THE DRAWINGS

Further advantages and individual features are evident from the following description of an embodiment and from the drawings, in which:

FIG. 3 shows the sliding guide shoe of FIG. 2 with a removed slide element and demounted securing part, FIG. 4 shows a sliding guide shoe, which is not yet assembled to finished state, with an opened carrier element for reception of the slide element, FIG. 5 shows the sliding guide shoe with partly pushed-in slide element.

DETAILED DESCRIPTION

Figure 1:
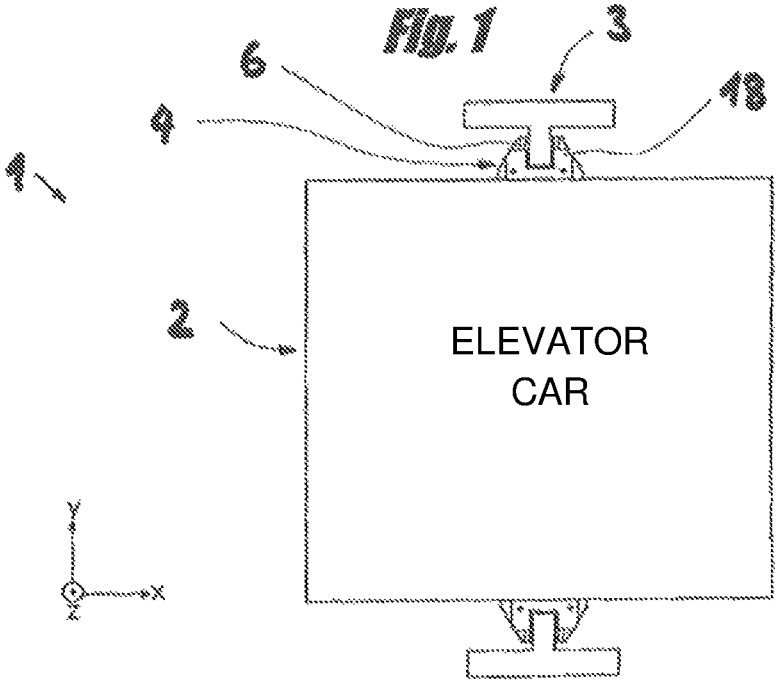
FIG. 1 shows a simplified illustration of an elevator with an elevator car guided by way of sliding guide shoes at guide rails, in plan view.

FIG. 1 shows an elevator, which is denoted overall by 1, with an elevator car 2, which is vertically guided between two guide rails 3 in an elevator shaft (not shown) of a building to be movable up and down. The travel direction of the car is indicated by an arrow z. The guide rail 3 is formed, for example, by a T profile member extending in z direction. At least one guide shoe 4 for guiding the car 2 at the guide rails 3 is arranged at the elevator car 2 on each side. The guide shoe is a sliding guide shoe comprising an insert 6, which is U-shaped in cross-section and which embraces the guide rail 3 and extends—like the guide rails—in longitudinal direction z.

Figure 2:
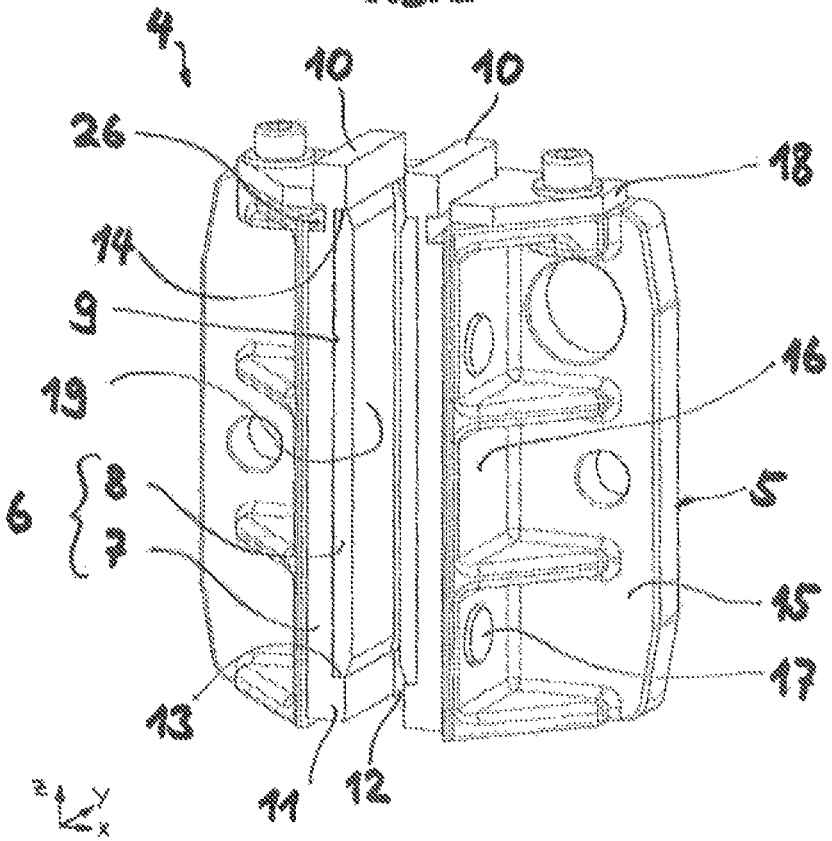
FIG. 2 shows a perspective view of a sliding guide shoe according to the invention.

As evident from FIG. 2, the sliding guide shoe 4 comprises a metallic guide shoe housing 5, which is of one-piece form in the present case, and an insert 6 inserted therein. The insert 6 is of two-part construction and has, as inner insert part, a slide element 8 facing the guide rail and, as outer insert part, a carrier element 7 for carrying the slide element. The outer insert part 7 consists of a material by which noise and vibrations can be damped during car travel. By contrast, the slide element 8 is of comparatively stiff form. The slide element has two planoparallel slide surfaces 19 and a slide surface which extends transversely to and connects these. The slide element 8 is made from a plastics material distinguished by a low coefficient of friction such as, for example, PTFE or UHMW-PE.

The guide shoe housing 5 consists of a plate-shaped base 15 and two support walls 16, which protrude vertically from the base and which form a channel-shaped receptacle, which extends in longitudinal direction z, for the insert 6. The carrier element 7 has two bearing pins 17 respectively on the outer sides, which pins engage in corresponding cut-outs in the support walls of the guide shoe housing 5, whereby the insert 6 is fixed in the guide shoe housing 5. The support element 7 is designed as a monolithic component which is U-shaped in cross-section having two limbs 11 and a base 12 which extends transversely to and connects the limbs. A resilient synthetic material (for example TUR, EPDM, NBR, NR), for example, is usable as material for the carrier element 7. The respective guide surfaces of the guide rail are acted on in sliding manner with small play by the slide surfaces of the slide element 8 during travel movement in z direction. The slide element 8 is received in a recess 9 formed to be complementary to the slide element. The recess 9 is formed in the carrier element 7 as a receiving pocket. The carrier element 7 has a respective abutment for the slide element at each of the upper and lower ends of the recess 9. The lower (or upper depending on how the sliding guide shoe has been mounted on the car) abutment, which is denoted by 13, is formed by a shoulder which downwardly bounds the recess. The slide element 8 is supported on the opposite side at a shoulder 14 which is a component of a detent connection described in more detail in the following. A securing section 10, thanks to which the slide element 8 is captively fixed in the carrier element 7, closes the recess upwardly (or downwardly).

The two mutually opposite securing sections 10 connected with the two limbs 11 of the carrier element protrude at the longitudinal side beyond the guide shoe housing 5. A securing part 18 is screw-connected with the longitudinal end of the guide shoe housing for fixing and ensuring a secure seat. The securing sections 10 are supported laterally at the securing part 18, whereby the flexible securing sections 10 are prevented from being able to move outwardly.

In order that the slide element can be inserted, the securing part has to be unscrewed and removed. FIG. 3 shows the guide shoe in this state. It is particularly evident from FIG. 3 that the recess 9 for receiving the slide element is designed as a receiving pocket. The recess, which extends over the entire width of the limbs 11 in z direction, is closed with respect to the longitudinal direction z on each side by the shoulders 13 and 14. For opening, the securing sections 10 have to be urged outwardly. This can be carried manually or possibly with the help of a tool. The corresponding movement direction is indicated by the arrows a. Recesses 26 extending transversely to the longitudinal direction z produce a local weakening in the carrier element 7, whereby the securing sections 10 can be urged outwardly in simple manner and with little expenditure of force. However, particularly in the case of thin-walled carrier elements it would also be conceivable not to provide recesses or other local weakenings.

As FIG. 4 shows, when the securing sections 10 are urged away an introduction opening arises, through which or into which the slide element can be pushed in simple manner in e direction into the upwardly open recess denoted by 9'. A bending edge about which the securing section 10 has been kinked is indicated by 25. However, a sharp kink of that kind is not usually present under actual conditions.

FIG. 5 shows the sliding guide shoe during a pushing in process. Since the slide element 8 can also be withdrawn or inserted when the rest of the sliding guide shoe remains at the guide rail, substantial advantages arise for maintenance outlay with respect to time saving and manageability. The laborious and time-consuming demounting of the entire sliding guide shoe from the car can thus be eliminated. After completion of the pushing-in process, the securing sections 10 automatically return to the original rest position thereof due to the restoration capability of the material for the carrier element, an advantageous detent connection thus arising.

Figure 6:
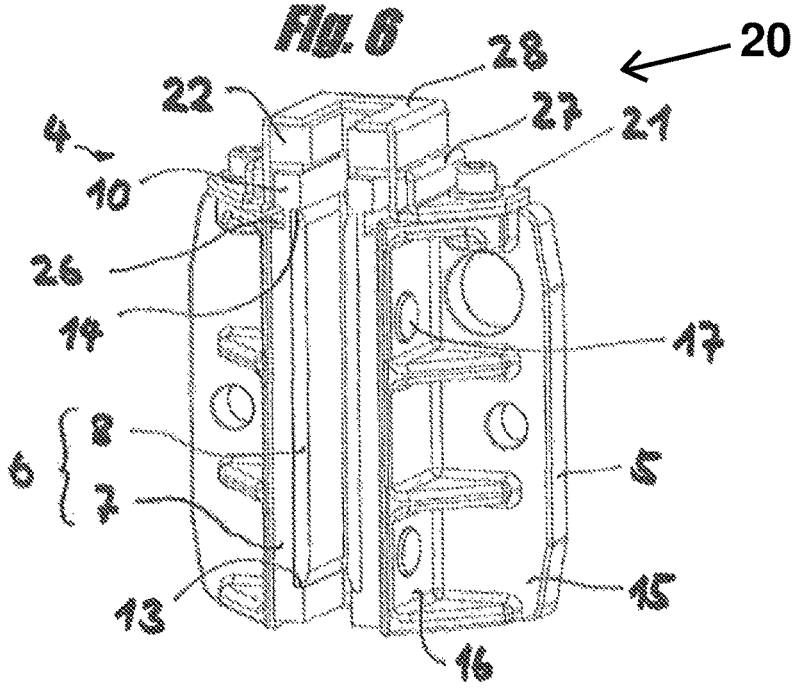
FIG. 6 shows a variant of the sliding guide shoe according to FIG. 2

Instead of the simple securing part according to the present embodiment, in the variant according to FIG. 6 a multi-part element is fastened to the guide shoe housing 5. The mentioned multi-part element 20 comprises an insert 22 which, for example, consists of a felt saturated with oil. This felt element 22 has inner surfaces which face the slide surfaces of the guide rail and which contact the slide surfaces. Through the contacting action by the felt element, the guide rails can be coated with a light oil film as soon as the car travels. The element, which is denoted entirely by 20, is therefore termed lubrication attachment in the following.

Figure 7:
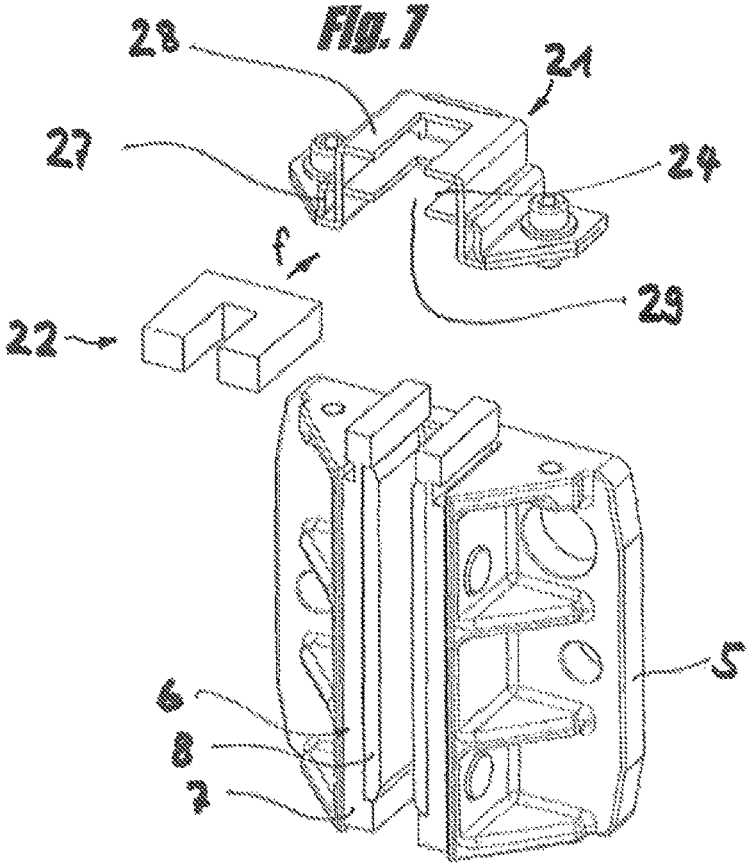
FIG. 7 shows the sliding guide shoe of FIG. 6 with demounted lubrication attachment.

The lubrication attachment 20, which is attachable at the longitudinal end of the guide shoe housing, further consists of a support structure 21 which has a receiving space 24 adapted to the oil insert. As evident from FIG. 7, the oil insert 22 can be inserted in f direction into the receiving space 24 of the support structure 21. In the present embodiment the support structure 21 consists of two bent parts 27, 28 of metal (for example, steel). The bent parts 27, 28 can be placed together in such a way that a receiving space 24 is created, in which the oil insert is received or receivable in sandwich-like manner between the U-shaped area sections of the bent parts 27, 28. The oil insert 22 is thus captively retained in the support structure 21, preferably lightly clamped between the planoparallel surface sections of the bent parts 27, 28. The bent part 27 has a recess 29, in which the securing section 10 is guided and which laterally supports the securing section 10 for securing purposes, adapted to the carrier element 7. The lubrication attachment 20 can be screw-connected in simple manner by means of two fastening screws to the guide shoe housing 5. When the oil insert 22 is dry and thus lubrication of the guide rails is no longer guaranteed, the oil inserts have to be replaced by oil-saturated felt elements. However, it would obviously also be conceivable to freshly saturate the dried-out insert 22 with a lubricating oil. By comparison with known solutions, which operate with oil reservoirs and feeds, this solution has the advantage that on the one hand it is favorable and simple in handling and on the other hand it is ensured that an excessive amount of oil is not applied to the guide rails. It has proved that even in different climatic conditions (for example conditions liable to change; tropical conditions, arctic conditions) satisfactory and substantially consistent lubricating results can be achieved. Other materials able to accept lubricating oils would obviously also be conceivable instead of a felt part as oil insert 22. For example, foam materials of synthetic or animal material are conceivable.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A sliding guide shoe for an elevator for conveying persons or goods, comprising:

a guide shoe housing for attachment to an elevator car, and an insert removably inserted into the guide shoe housing for guidance of the elevator car along a guide rail extending in a longitudinal travel direction, wherein the insert includes a slide element facing the guide rail when the guide shoe housing is attached to the elevator car and a carrier element with a recess receiving the slide element, wherein the recess is formed as a receiving pocket for the slide element and the carrier element is configured such that the slide element is introducible into and removable from the recess in the longitudinal travel direction so that after the slide element is introduced into the recess the slide element is captively fixed in the carrier element, wherein the carrier element includes a shoulder at each end of the recess that extends laterally towards the recess and bound the recess in the longitudinal travel direction and captively fix the slide element in the carrier element.

2. The sliding guide shoe according to claim 1 wherein the slide element is detentable in the carrier element.

3. The sliding guide shoe according to claim 1 wherein the carrier element has at least one movable or flexible securing section for securing the slide element inserted into the carrier element, the securing section being movable or deformable outwardly for forming an introduction opening for the slide element.

4. The sliding guide shoe according to claim 3 wherein the carrier element when inserted into the guide shoe housing has a section that projects beyond the guide shoe housing.

5. The sliding guide shoe according to claim 3 wherein the carrier element is locally weakened in a region of the securing section, whereby the securing section can be more easily moved for enlarging the introduction opening.

6. The sliding guide shoe according to claim 5 wherein the local weakening is a recess that extends in the carrier element transversely to the longitudinal travel direction.

7. The sliding guide shoe according to claim 3 including a securing part for securing the securing section in a rest setting is mounted on the guide shoe housing, wherein the securing section is supported laterally outwardly by the securing part.

8. The sliding guide shoe according to claim 1 wherein the carrier element, at least when inserted in the guide shoe housing, is formed as a profile member having a U-shaped cross-section with two limbs connected by a base, and the limbs project beyond the guide shoe housing and the base is shorter relative to the limbs.

9. The sliding guide shoe according to claim 1 wherein the slide element is formed as a U-shaped profile member.

10. A sliding guide shoe for an elevator for conveying persons or goods, comprising:

a guide shoe housing for attachment to an elevator car, and an insert removably inserted into the guide shoe housing for guidance of the elevator car along a guide rail extending in a longitudinal travel direction, wherein the insert includes, a slide element facing the guide rail when the guide shoe housing is attached to the elevator car, and a carrier element with a recess receiving the slide element, wherein the recess is formed as a receiving pocket for the slide element, the carrier element is configured such that the slide element is introducible into and removable from the recess in the longitudinal travel direction so that after the slide element is introduced into the recess the slide element is captively fixed in the carrier element, and the carrier element has at least one movable or flexible securing section for securing the slide element inserted into the carrier element, the securing section being movable or deformable outwardly for forming an introduction opening for the slide element, wherein the carrier element includes a shoulder at each end of the recess that extends laterally towards the recess and bound the recess in the longitudinal travel direction and captively fix the slide element in the carrier element.

11. A method for inspection of an elevator installation with at least one sliding guide shoe attached to an elevator car comprising the following steps:

providing the at least one sliding guide shoe with a guide shoe housing and an insert removably inserted into the guide shoe housing for guidance of the elevator car along a guide rail extending in a longitudinal travel direction, wherein the insert includes a slide element facing the guide rail when the guide shoe housing is attached to the elevator car and a carrier element with a recess receiving the slide element, wherein the recess is formed as a receiving pocket for the slide element and the carrier element is configured such that the slide element is introducible into and removable from the recess in the longitudinal travel direction so that after the slide element is introduced into the recess the slide element is captively fixed in the carrier element, wherein the carrier element includes a shoulder at each end of the recess that extends laterally towards the recess and bound the recess in the longitudinal travel direction and captively fix the slide element in the carrier element;

stopping the elevator car along guide rail; and exchanging the slide element for another slide element, wherein in the exchange process the at least one sliding guide shoe together with the carrier element remain at the guide rail and wherein the slide element is removed from the carrier element by withdrawal along the longitudinal travel direction and the another slide element is then inserted in an introduction process along the longitudinal travel direction into the carrier element to captively fix the another slide element in the carrier element.

* * * * *